United States Patent [19]

Kajino et al.

[11] Patent Number: 4,887,056

[45] Date of Patent: Dec. 12, 1989

[54] MAGNET SWITCH FOR A STARTER

[75] Inventors: Sadayosi Kajino, Nagoya; Atsuomi Iida, Chiryu, both of Japan

[73] Assignee: Nippondenso Co., Ltd., Kariya, Japan

[21] Appl. No.: 163,099

[22] Filed: Mar. 2, 1988

[30] Foreign Application Priority Data

May 14, 1987 [JP] Japan ..... 62-117490

[51] Int. Cl.[4] ..... H01H 67/02

[52] U.S. Cl. ..... 335/126; 335/131

[58] Field of Search ..... 335/126, 131, 193, 157, 335/168, 264

[56] References Cited

U.S. PATENT DOCUMENTS 4,251,788 2/1981 Barthruff et al. ..... 335/131
4,579,010 4/1986 Colvin et al. ..... 335/131

FOREIGN PATENT DOCUMENTS 18-27854 11/1943 Japan .
54-137771 9/1979 Japan .

OTHER PUBLICATIONS

Journal of Nippondenso Technical Disclosure; 1/20/1981-14-105, p. 39.
Journal of Nippondenso Technical Disclosure; 4/20/1979-14-105, p. 105.
Journal of Nippondenso Technical Disclosure; 1/15/1984-33-165, p. 165.

*Primary Examiner*—Clifford C. Shaw
*Assistant Examiner*—Lincoln Donovan
*Attorney, Agent, or Firm*—Cushman, Darby & Cushman

[57] ABSTRACT

A magnet switch arrangement having a long flow path through which outside air must pass to enter the inner chamber of the switch where its working contacts are located to prevent the accumulation of dust and moisture therein. A coil unit (3) having a bobbin (4) is provided within a switch housing (2), the bobbin having a cylindrical portion (**4*a*) and a pair of end faces (4*b*,4*c*) formed at both sides of the cylindrical portion. A solenoid coil (5,6) is wound on the bobbin's cylindrical portion. A coil chamber (D) is formed between the coil unit and the switch housing. A cylindrical non-magnetic sleeve (7) isolates the inside from the outside of the coil chamber. A plunger having a movable contact is movable inside of the sleeve so that the plunger shifts the pinion toward the ring gear when the solenoid coil is energized. A switch cover (16) includes a contact chamber for covering the movable contact. Fixed contacts (17*a*,17*b***) are provided on the switch cover for supplying electrical power to be switched. A first passage is defined between the contact chamber and the plunger chamber. The sleeve and the cylindrical portion of the bobbin define a second passage therebetween which connects the coil chamber on the switch cover side and the plunger chamber. A third passage connects the coil chamber with an outside of the switch housing.

15 Claims, 4 Drawing Sheets

MAGNET SWITCH FOR A STARTER

BACKGROUND OF THE INVENTION

1. Field of the Invention

The present invention relates in general to switches used to activate a starting motor of a vehicle.

2. Description of the Prior Art

Known starter magnet switches are structurally arranged in such a manner that moisture and dust laden air flows from outside of the switch all the way into the innermost cavities thereof which contain the switch contacts. There, dust and water tend to accumulate on the fixed and movable contacts and degrade the performance of the switch. In cold weather, the water on the contacts freezes to ice which can completely prevent electrical contact from being made.

One known switch arrangement is disclosed in the Open Technical Report, of Nippondenso No. 21-039 (issued on Jan. 20, 1981). A hole is formed in a plunger boot of the switch so that a plunger chamber within a coil communicates with the inside of a starter housing through a gap between an inner surface of the coil and an outer surface of the plunger. Accordingly, air compressed within the plunger chamber as a result of movement of a plunger flows into the inside of the starter housing through the gap and the hole of the plunger boot. The distance between the inside of the starter housing and the plunger chamber is short, and especially the length of the hole of the plunger boot is very short. Accordingly, upon the plunger's return stroke, water that has entered the starter housing may enter the plunger chamber through the short gap. Since the contact chamber communicates with the plunger chamber, the volume of the plunger boot and the plunger chamber becomes small when the plunger returns. Water having entered the plunger chamber moves easily into the contact chamber. Similarly, dust can easily enter into the conduct chamber. Water in the contact chamber freezes in cold weather thereby preventing electrical connection between contacts and dust accumulating in the chamber tends to deteriorate performance.

SUMMARY OF THE INVENTION

It is an object of the present invention to provide a magnet starter switch that is not easily deteriorated by water and dust, by providing a structural arrangement that prevents water and dust from entering the contact chamber.

It is another object of the present invention to provide a structural arrangement for a magnet starter that can be easily manufactured at low cost.

According to the present invention, the switch is structured so that the passage between the contact chamber and the outside is elongated with respect to prior art devices by making use of a long passage between the inner circumference of a bobbin and a sleeve. The outside communicates with the long passage through a coil chamber. This long passage presents a high flow resistance to the air, air carrying dust and water droplets are substantially prevented from entering the chamber through the long passage.

More particularly, the invention provides a magnet switch arrangement having a long flow path through which outside air must pass to enter the inner chamber of the switch where its working contacts are located to prevent the accumulation of dust and moisture therein.

A coil unit (3) having a bobbin (4) is provided within a switch housing (2), the bobbin having a cylindrical portion (4*a*) and a pair of end faces (4*b*,4*c*) formed at both sides of the cylindrical portion. A solenoid coil (5,6) is wound on the bobbin's cylindrical portion. A coil chamber (D) is formed between the coil unit and the switch housing. A cylindrical non-magnetic sleeve (7) isolates the inside from the outside of the coil chamber. A plunger having a movable contact is movable inside of the sleeve so that the plunger shifts the pinion toward the ring gear when the solenoid coil is energized. A switch cover (16) includes a contact chamber for covering the movable contact. Fixed contacts (17*a*,17*b*) are provided on the switch cover for supplying electrical power to be switched. A first passage is defined between the contact chamber and the plunger chamber. The sleeve and the cylindrical portion of the bobbin define a second passage therebetween which connects the coil chamber on the switch cover side and the plunger chamber. A third passage connects the coil chamber with an outside of the switch housing.

DETAILED DESCRIPTION OF THE PREFERRED EMBODIMENTS

Figure 1:
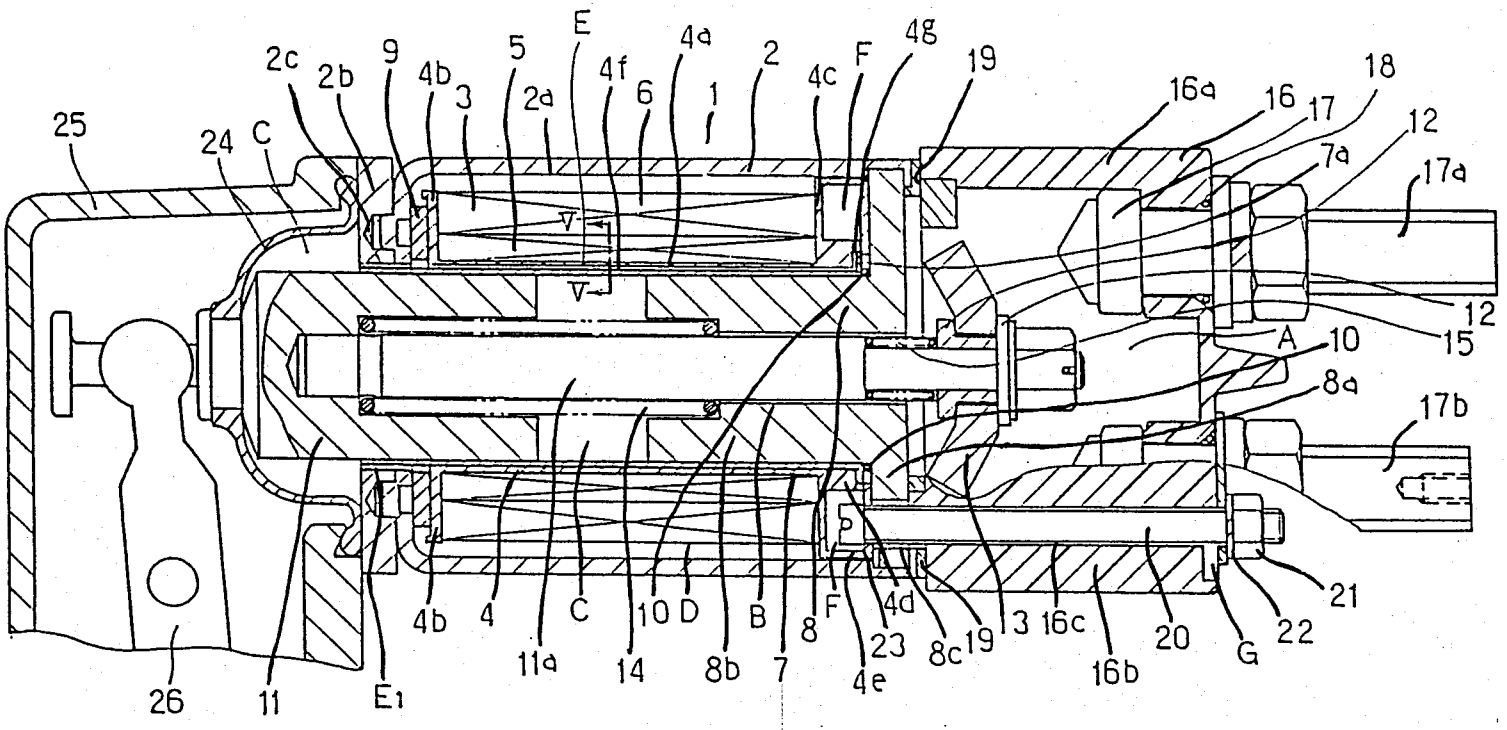
FIG. 1 is a sectional view showing one embodiment of the starter magnet switch according to the present invention.

FIG. 1 is a sectional view of a starter magnet switch 1 according to the present invention. A housing 2 of switch 1 has a cylindrical portion 2*a* and a disk-shaped flange portion 2*b* formed at one end of the cylindrical portion 2*a* and bent inward. A coil unit 3 includes a resin bobbin 4 having a cylindrical portion 4*a* and first and second end faces 4*b* and 4*c* formed at the two ends of the cylindrical portion 4*a*; a holding coil 5 wound on the cylindrical portion 4*a* of the bobbin 4; and an attracting coil 6.

Figure 2:
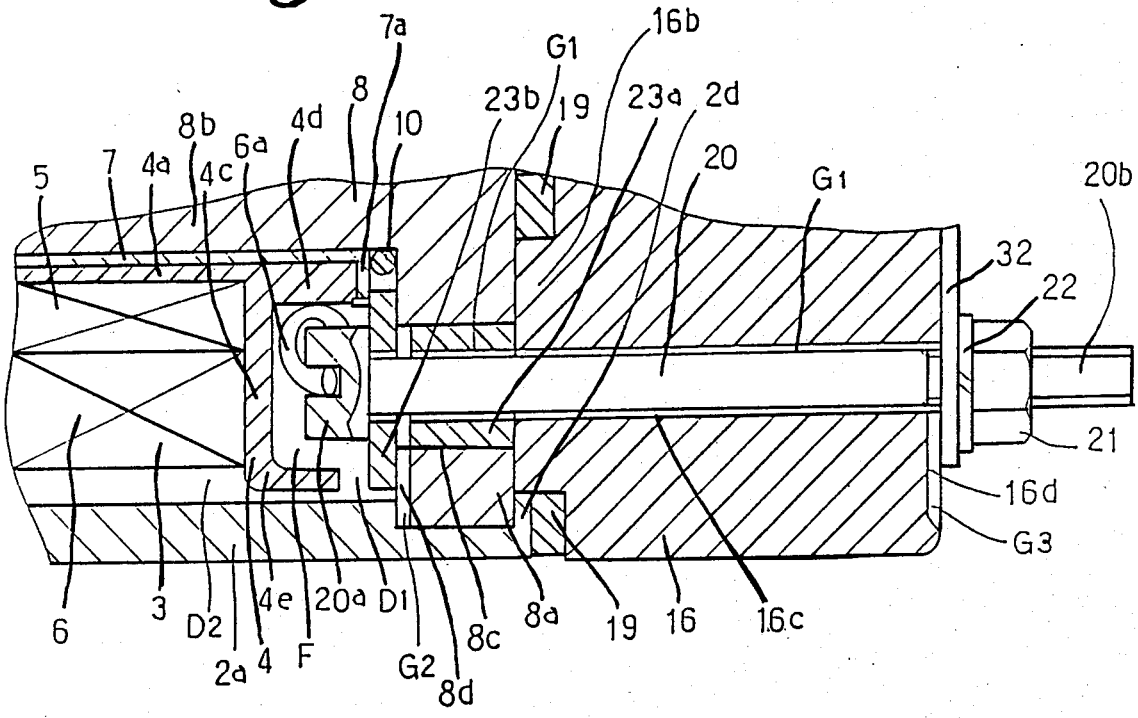
FIG. 2 is a sectional view showing an essential portion of the switch of FIG. 1 in an enlarged scale.
Figure 4:
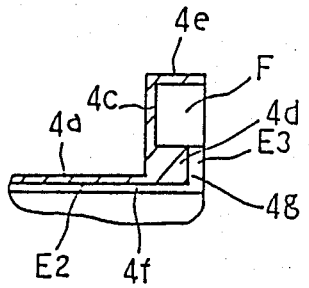
FIG. 4 is a sectional view showing an essential portion of the bobbin.
Figure 3:
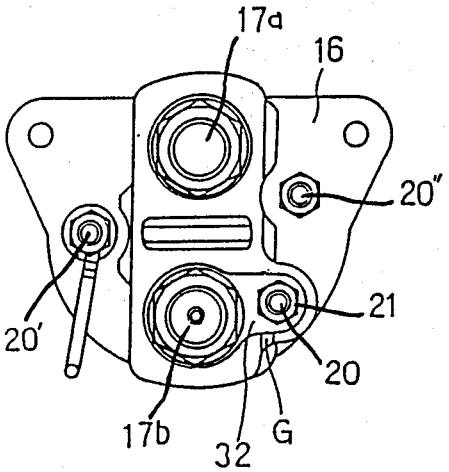
FIG. 3 is a side elevation showing the switch of FIG. 1.

As shown in FIGS. 2 and 4, at the inner and outer circumferences of the second end face 4*c* of the bobbin 4, respectively, there are formed first and second cylindrical portions 4*d* and 4*e*, between which are formed an annular space F. An axially extending first groove 4*f* is formed in the inner circumference of the cylindrical portion 4*a*, and a cross-sectional area of the groove 4*f* is about 0.5 $mm^2$ and a second groove 4*g* for providing communication between the first groove 4*f* and the space F is formed at the end face of the first cylindrical portion 4d.

A sleeve 7, made of a non-magnetic material, is arranged to abut against the inner circumference of the cylindrical portion 4a of the bobbin 4 and to face the inner circumference 2c of the flange portion 2b of the switch housing 2 through a small gap $E_1$. The sleeve 7 thus constructed has its end portion formed integrally with a flange portion 7a which is bent toward the outer circumference. A stationary core 8 has a disk portion 8a, which is arranged at the second end face 4c of the bobbin 4, and a cylindrical portion 8b which extends from the inner circumference of the disk portion 8a along the inner circumference of the sleeve 7. The disk portion 8a is formed with three through holes 8c. A packing 9 is sandwiched between the first end face 4b of the bobbin 4 and the flange portion 2b of the switch housing 2. An O-ring 10 is sandwiched between the flange portion 7a of the sleeve 7 and disk portion 8a of the stationary core 8.

As shown in FIG. 2, when the fixed iron core 8 is to be fastened around the switch housing 2 by fastening the open end 2d of the switch housing 2 around the outer circumference of the disk portion 8a of the stationary core 8, the packing 9, the first and second end faces 4b and 4c and the first cylindrical portion of the bobbin 4, the flange portion 7a of the sleeve 7 and the O-ring 10 are pressed onto the flange portion 2b of the switch housing 2 by the disk portion 8a of the stationary core 8. The sleeve 7 has its inner and outer circumferences spaced by compressing the packing 9 and the O-ring 10 by that pressure.

A plunger 11 is arranged movably in the inner circumference of the sleeve 7. A plunger rod 11a has one end fixed to a movable contact 13 through an insulating member 12. A small gap B is formed between the outer circumference of the plunger rod 11a and the inner circumference of the cylindrical portion 8b of the stationary core 8. A return spring 14 is mounted between the plunger 11 and the stationary core 8. A contact pressure spring 15 is mounted between the plunger rod 11a and the insulating member 12. A switch cover 16 made of a resin includes a cover portion 16a for accommodating the movable contact 13 within its inner circumference and a fixed portion 16b abutting against the disk portion 8a of the stationary core 8. The fixed portion 16b is also formed with three holes 16c which are aligned with the through holes 8c of the disk portion 8a of the stationary core 8.

First and second fixed contacts 17a and 17b, respectively, are fixed on the switch cover 16 in a sealed fashion by means of an O-ring 18 as to abut against the movable contact 13. A packing 19 seals the fixed portion 16b of the switch cover 16 and the open end 2d of the switch housing 2, and the disk portion 8a of the stationary core 8 and the fixed portion 16b of the switch cover 16. A bolt 20, a nut 21, and a washer 22 together constitute a first fixing means. The bolt 20 has its head 20a inserted into the space F within the first and second cylindrical portions 4d and 4e of the bobbin 4 and its threaded portion 20b projecting to the outside of the switch cover 16 through the through hole 8c of the stationary core 8 and the hole 16c of the switch cover 16. By fitting the washer 22 on the threaded portion 20b and fastening it by the nut 21, the switch cover 16 is pressed and fixed on the stationary core 8. Cylindrical and circular insulating bushes 23a and 23b, respectively, insulate the bolt 20 and the stationary core 8, respectively.

Bolt 20, cylindrical insulating bush 23 and the hole 16c of the switch cover 16 are so spaced to form a first air passage $G_1$. That side of the disk portion 8a of the stationary core 8, which faces the disk-shaped insulating bush 23b, is formed with a groove 8d for establishing a second air passage $G_2$ for providing communication between the space F and the first air passage $G_1$. The outer circumference of the fixed portion 16b of the switch cover 16 is formed with a groove 16d which extends radially outwardly of the washer 22 for establishing a third air passage $G_3$ for communicating with the first air passage $G_1$. Thus, the first, second, and third air passages $G_1$, $G_2$, and $G_3$ together form an air passage for providing communication between the inside and outside of the switch housing 2.

A plunger boot 24 has its inner circumference mounted with an allowance on the plunger 11 and its outer circumference sandwiched fixedly between a housing 25 and the switching housing 2 to isolate the housing 25 and the magnet switch 1. By the plunger boot 24, moreover, a plunger chamber C is kept away from oil, water, dust and so on through the opening (although not shown) of the housing 25 in which a pinion 28 and a ring gear 29 mesh with each other. A lever 26 engages with the plunger 11.

The overall electric circuit of the starter will be described with reference to FIG. 6. A starter motor 27 is equipped with a coil 27a and an armature 27b. A pinion 28 engages with the other end of the lever 26 for receiving the bobbins of the starter motor 27 transmitted thereto. Reference numeral 29 denotes the ring gear of an internal combustion engine.

The node between one terminal of the holding coil 5 and one terminal of the attracting coil 6 is connected with a battery 31 through a key switch 30. The other terminal of the attracting coil 6 is connected with the coil 27a of the starter motor 27. The other terminal of the holding coil 5 is grounded to ground through a shunt coil 27c. The first fixed contact 17a is connected directly with the battery 31, whereas the second fixed contact 17b is connected like the one terminal of the attracting coil 6 to the coil 27a.

Figure 6:
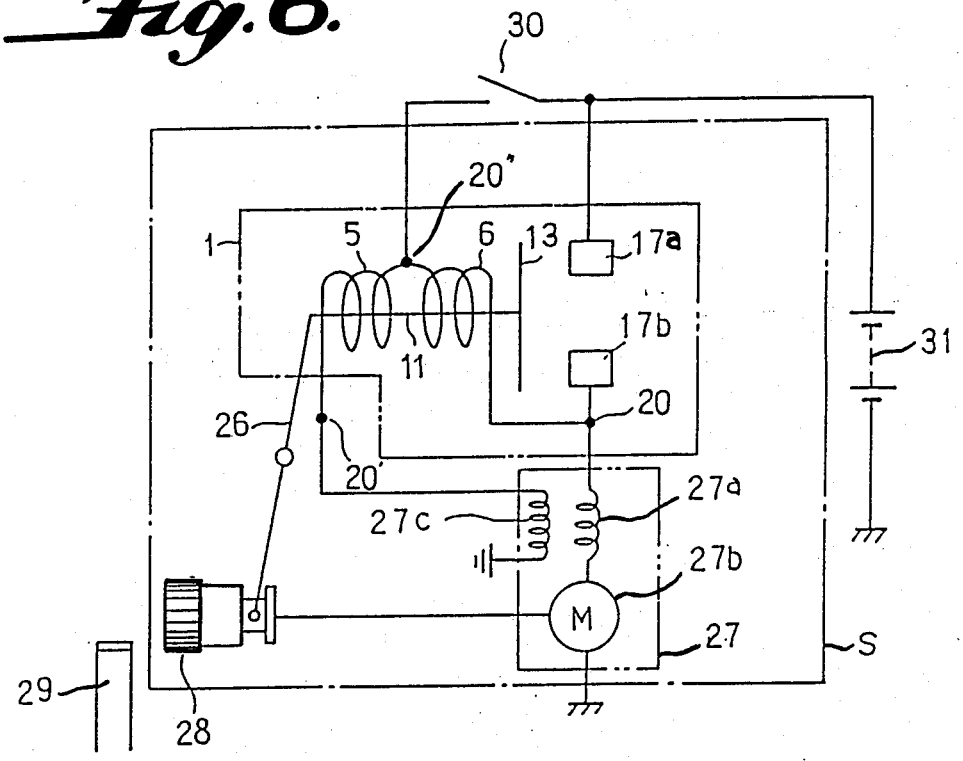
FIG. 6 is an electric circuit diagram of a starter.

Coil 27a is electrically connected with the other terminal 6a of the attracting coil 6, as shown in FIG. 2, by connecting the other terminal 6a of the attracting coil 6 with the head 20a of the first bolt 20, the first bolt 20 and the second fixed contact 17b through a metal plate 32, and by connecting the coil 27a of the starter motor 27 with the second fixed contact 17b, as shown in FIG. 6. With a second bolt 20'', moreover, there are connected one terminal 5a of the holding coil 5 and one terminal of the attracting coil 6. By connecting the battery 31 with that second bolt 20'' through the key switch 30, as shown in FIG. 6, the second bolt 20'' for fixing the switch cover 16 also acts as the terminal like the first bolt for supplying the electric power to the holding coil 5 and the attracting coil 6.

The other terminal of the holding coil 5 is connected with a third bolt 20' through which a lead wire is connected with the shunt coil 27c. Bolts 20' and 20'' also have their heads (although not shown) disposed in the space F to fix the switch cover 16. Incidentally, the bolts 20' and 20'' are not formed in their outer circumferences with air passages for providing communication between the outside and the switch housing.

The operations of the magnet starter switch will now be described. When key switch 30 is closed, current flows from the battery 31 via the second bolt 20'' to the holding coil 5 and the attracting coil 6 to attract the plunger 11. At this time, the current having passed through the holding coil 5 flows through the shunt coil **27*c* via the third bolt 20'. As the plunger 11 moves, the pinion 28 comes into meshing engagement with the ring gear 29 through the lever 26. The movable contact 13 comes into abutment against the first and second fixed contacts 17*a* and 17*b* to feed the starter motor 27 with the current of the battery 31 so that the armature 27*b* and accordingly the pinion 28 rotates to start the internal combustion engine. Since, at this time, the second fixed contact 17*b* and the first bolt 20 are connected, the two terminals of the attracting coil 6** are at the same potential and there is no current flowing therebetween.

Figure 5:
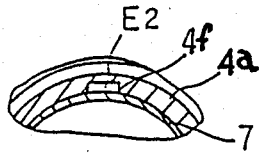
FIG. 5 is a sectional view showing an essential portion and taken along line V—V of FIG. 1.
Figure 7:
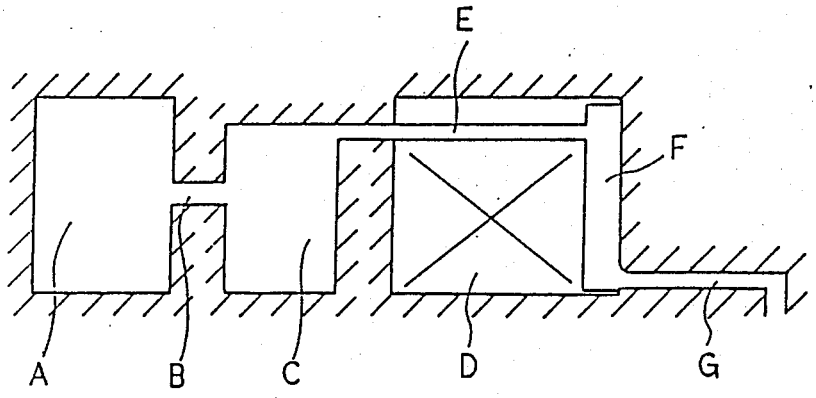
FIG. 7 is a schematic view showing the switch of FIG. 1.

The invention will now be described with reference to FIGS. 1 and 7. A contact chamber A in the switch cover 16 communicates with the plunger chamber C via the gap B which is formed between the plunger rod **11*a* and the cylindrical portion 8*b* of the stationary core 8. This plunger chamber C in turn communicates with the space F between the first and second cylindrical portions 4*d* and 4*e* through the gap $E_1$ between the inner circumference 2*c* of the flange portion 2*b* of the switch housing 2 and the sleeve 7, the gap E2 (as better seen from FIGS. 4 and 5) between the first groove 4*f* of the bobbin 4 and the sleeve 7, and the gap E3 between the second groove 4*g* of the bobbin 4 and the flange portion 7*a* of the sleeve 7. Space F in turn communicates with a coil chamber D2 through a gap D1 between the second cylindrical portion 4*e* of the bobbin 4 and the bush 23**. The space F further communicates with the outside through the first, second, and third air passages $G_1$, $G_2$, and $G_3$.

The third air passage $G_3$ is directed downward when the starter is mounted. At this time, the first groove **4*f* of the bobbin 4 is arranged upward (i.e., in the opposite direction) with respect to the air passage G. With this structure thus far described, when the plunger 11 is attracted in the operation of the magnet switch 1, the air in the contact chamber A and the plunger chamber C is compressed so that the compressed air is released through the passages B, C, D, E, F, and G to the outside. This compression of air prevents the plunger boot 24 and the packing 19 from coming out. Since, on the other hand, the air heated to have an increased pressure by the coil 3** is also released from the passages F and G, the aforementioned seals or the like are prevented from coming out.

When the magnet switch 1 is turned off to return the plunger 11, on the contrary, the ambient air passes through the passage G into the magnet switch 1. However, the passage to the contact chamber A is long enough to include the passages F and E, the plunger chamber C and the passage B so that the water content or dust in the ambient air can be blocked from flowing into the chamber containing the switch contacts. Even if water should enter from the passage G, it would hardly flow into the plunger chamber C through the passage E and not at all into the contact chamber A because it is upwardly apart from the passage G.

Furthermore, the air passage G between the space F and the outside can be formed with remarkable ease by fixing the switch cover 16 on the housing 2 and by making use of the insertion hole of the bolt 20 for connecting the attracting coil 6 and the coil **27*a* of the starter motor 27. When the plunger 11 moves toward the fixed contacts 17*a* and 17*b*, air compressed within the plunger chamber C as a result of movement of the plunger 11 flows into the outside of the magnet switch 1 through the gap between the sleeve 7 and the plunger 11, and the space within the plunger boot 24. Then the movable contact 13 comes into abutment against the first and second fixed contacts 17*a* and 17*b*, the volume of the plunger boot 24 and the plunger chamber C becomes smallest, as shown in FIG. 8 (the invention) and FIG. 9** (prior art).

Figure 9:
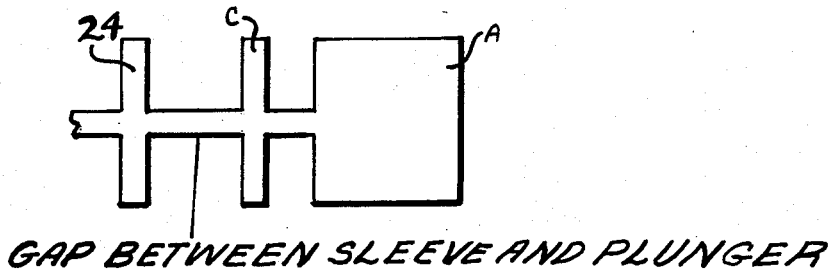
Fig. 9. (PRIOR ART)
FIG. 9 is a schematic diagram showing the various chamber volumes according to a prior art device which does not prevent dust and moisture from entering the inner chamber of the switch.

In the prior art as shown in FIG. 9, the distance between the plunger chamber C and the outside of the magnet switch 1 is short and the volume of the plunger boot 24 is small. Accordingly, upon the plunger's return stroke, water in the outside of the magnet switch 1 may enter directly into the plunger chamber C through the short distance. Since the contact chamber A communicates with the plunger chamber C, water having entered the plunger chamber C moves easily into the contact chamber C. Similarly, dust can easily enter the conduct chamber.

Figure 8:
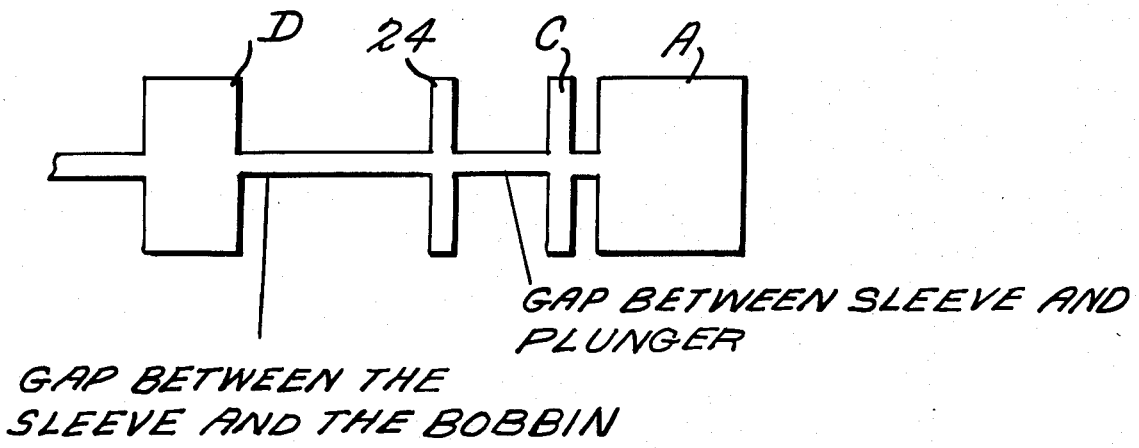
FIG. 8 is a schematic diagram showing the enhanced chamber volumes of the present invention which help to prevent dust and moisture from entering the inner chamber of the switch.

As shown in FIG. 8, the passage between the contact chamber A and the outside of the magnet switch 1 is elongated with respect to the prior art by making use of the long passage between the inner circumference of a bobbin 4 and a sleeve 7, and the coil chamber D. Since the outside communicates with the long passage through the coil chamber D and the long passage prevents a high flow resistance to the air, air carrying dust and water droplets is substantially prevented from entering the plunger chamber through the long passage.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

We claim:

1. A magnet switch for shifting a pinion of a starter motor toward a ring gear of an internal combustion engine, and for supplying current from a battery to said starter motor comprising:

a cylindrical switch housing;

a coil unit having a bobbin provided within said switch housing, said bobbin comprising a cylindrical portion and a pair of end faces formed at both sides of said cylindrical portion, and a solenoid coil wound on said cylindrical portion of said bobbin;

a coil chamber formed between said coil unit and said switch housing;

a cylindrical non-magnetic sleeve touching an inner surface of said cylindrical portion of said bobbin so that said sleeve isolates between an inside and outside of said coil chamber;

a plunger having a movable contact and arranged movably inside of said sleeve so that said plunger shifts said pinion toward said ring gear when said solenoid coil is energized;

a switch cover comprising a contact chamber for covering said movable contact;

a fixed contact provided on said switch cover, and for supplying electrical power to said starter motor from said battery when said movable contact closes said fixed contact;

means, including said plunger, for defining a first passage between a contact chamber and said plunger chamber;

said sleeve and said cylindrical portion of said bobbin defining a second passage therebetween, said second passage connecting said coil chamber on said switch cover side and said plunger chamber on said switch cover opposite side; and means for defining a third passage connecting said coil chamber with an outside of said switch housing.

2. A magnet switch according to claim 1, wherein the elements thereof are arranged such that said third passage is directed downward when said starter is mounted on said engine.

3. A magnet switch according to claim 2, wherein the elements thereof are arranged such that said second passage is directed upward with respect to said third passage.

4. A magnet switch according to claim 1, wherein said means for defining said third passage is a gap between a hole through said switch cover and a fixed element passing through said hole that fastens said switch cover to said switch housing.

5. A magnet switch according to claim 4, wherein said fixed element comprises a bolt and a nut, said bolt having a head portion inserted within said switch housing and a threaded portion projecting to the outside of said switch cover, said nut being fixed to said threaded portion through a washer.

6. A magnet switch according to claim 5, wherein one end of said solenoid coil is connected to said head portion of said bolt.

7. A magnet switch according to claim 5, wherein said switch cover has a groove on an outer surface of said switch cover, said groove having one end communicating with said gap and the other end extending radially outwardly from said washer.

8. A magnet switch according to claim 5, wherein said bobbin has a first and a second cylindrical portion at inner and outer circumferences, respectively of said end face of said bobbin so that said head portion of said bolt inserts into a space (F) defined by said first and second cylindrical portions.

9. A magnet switch according to claim 3, wherein said second passage is defined by an outer surface of said sleeve and a surface of a first groove formed axially on an inner surface of said cylindrical portion of said bobbin.

10. A magnet switch according to claim 8, wherein said second passage is formed between said sleeve and a first groove formed axially on an inner surface of said cylindrical portion of said bobbin.

11. A magnet switch according to claim 10, wherein said bobbin has a second groove on said first cylindrical portion of said bobbin communicating between said first groove and said space.

12. A magnet switch according to claim 1, further comprising an annular stationary core fixed at an end of said switch housing so that said bobbin is held between said stationary core and a flange portion formed at the other end of said switch housing.

13. A magnet switch according to claim 12, wherein said first passage is a gap formed between an inner surface of said stationary core and an outer surface of a plunger rod of said plunger.

14. A magnet switch according to claim 12, wherein said sleeve has a flange portion fixed between said end face and said stationary core.

15. A magnet switch according to claim 12, further comprising:

a second housing for securing said switch housing; and an annular plunger boot having an inner part connected to said plunger, and an outer part fixed between said second housing and said switch housing.

* * * * *